US006843299B2

(12) United States Patent
Judkins

(10) Patent No.: US 6,843,299 B2
(45) Date of Patent: Jan. 18, 2005

(54) BRACKET RAIL FOR WINDOW COVERINGS

(76) Inventor: Ren Judkins, 46 Newgate Rd., Pittsburgh, PA (US) 15202

( * ) Notice: Subject to any disclaimer, the term of this patent is extended or adjusted under 35 U.S.C. 154(b) by 0 days.

(21) Appl. No.: 10/341,839

(22) Filed: Jan. 14, 2003

(65) Prior Publication Data

US 2004/0134628 A1 Jul. 15, 2004

(51) Int. Cl.[7] ..... E06B 9/38
(52) U.S. Cl. ..... 160/178.1 R; 160/902
(58) Field of Search ..... 160/178.1 R, 902, 160/168.1 R, 176.1 R, 173 R, 178.2 R, 405

(56) References Cited

U.S. PATENT DOCUMENTS

| | | | | |
|---|---|---|---|---|
| 2,698,727 A | * | 1/1955 | Rutledge | 248/264 |
| 2,837,152 A | * | 6/1958 | Moore, Jr. | 160/168.1 R |
| 4,235,406 A | | 11/1980 | Vecchiarelli | |
| 4,567,930 A | * | 2/1986 | Fischer | 160/166.1 |
| 4,607,818 A | | 8/1986 | Georgopoulos | |
| 4,886,103 A | * | 12/1989 | Baier | 160/178.1 R |
| 4,919,185 A | | 4/1990 | Comeau et al. | |
| 4,949,926 A | | 8/1990 | Liu | |
| 5,042,553 A | * | 8/1991 | Schaffer et al. | 160/178.1 R |
| 5,074,350 A | | 12/1991 | Carter | |
| 5,121,893 A | | 6/1992 | King et al. | |
| 5,228,149 A | | 7/1993 | Phinn, Jr. | |
| 5,230,493 A | * | 7/1993 | Luoto | 248/251 |
| 5,353,857 A | * | 10/1994 | Anderson | 160/178.1 R |
| 5,520,235 A | * | 5/1996 | Coleman | 160/89 |
| 5,533,560 A | | 7/1996 | Morris | |
| 6,263,945 B1 | * | 7/2001 | Nien | 160/173 R |
| 6,431,247 B1 | | 8/2002 | Harrison, Jr. et al. | |
| 6,550,523 B1 | * | 4/2003 | Chen | 160/178.1 R |
| 6,648,046 B1 | * | 11/2003 | Gibson | 160/39 |

FOREIGN PATENT DOCUMENTS

| | | |
|---|---|---|
| AU | B-54837/90 | 3/1991 |
| DE | 2 252 530 | 5/1974 |
| DE | 298 18 572 | 2/1999 |
| GB | 1 009 054 | 11/1965 |
| GB | 2 264 323 | 8/1993 |

OTHER PUBLICATIONS

Patent Abs. of Japan, Dec. 12, 2002, vol. 2002, No. 12, 227558A.

* cited by examiner

*Primary Examiner*—David Purol
(74) *Attorney, Agent, or Firm*—Buchanan Ingersoll PC

(57) ABSTRACT

A window covering system has a bracket rail with an elongated L-shaped body that extends across substantially the full width of a window. A plurality of brackets are attached to a headrail of a window covering and releasably attach the headrail to the bracket rail. Preferably, the brackets have a tab which engages the front edge of the bracket rail and an inverted U-shaped spring that engages the bottom edge of the bracket rail.

27 Claims, 8 Drawing Sheets

BRACKET RAIL FOR WINDOW COVERINGS

FIELD OF THE INVENTION

This invention relates to supports for blinds and more particularly to a rail for mounting and supporting a headrail of a window blind covering an opening such as a window. The window covering may be a venetian blind, pleated shade, cellular shade or roman shade.

BACKGROUND OF THE INVENTION

The most common headrails for venetian blinds, pleated shades, cellular shades and roman shades are made from a U-shaped channel which is mounted in a window opening by attachment either to the face of the window frame, or by an end mount to the inner walls of the window casing, or by an overhead mount to the upper wall of the casing or to the ceiling adjacent to the window. Almost always the headrail is mounted in any one of these three ways by two or more brackets. One type of bracket is cup-shaped and fits onto the end of the headrail. Another type of bracket is L-shaped and attaches to the top of the headrail. These brackets have screw holes in them positioned for each of the mounting connections. Most brackets are about two inches in width. The installer determines how many brackets to use and where to place the brackets relative to the headrail. Often installers use more brackets than are necessary or place them in the wrong positions. The forces that act on a window blind headrail are not equally distributed across the headrail. More force is applied to the end of the headrail at which the lift cord exits from the headrail. On occasion an installer will not place a bracket in the region of the headrail where the forces are greatest resulting in the headrail coming loose or falling. Sometimes the headrail is slightly smaller than the window opening in which it is mounted. When that occurs the headrail can move laterally because some of the brackets being used today do not prevent lateral movement of the headrail very well. Repeated lateral movements cause the shade to be off centered on the window and could result in damage to the headrail, the brackets and even the shade. Consequently, there is a need for a mounting system for window covering headrails that uses the right number of brackets, correctly positioned, for the forces that will act on the headrail. There is also a need for a window covering mounting system that will restrain the headrail from lateral movement. Brackets in use today are unattractive from outside the window especially where porches or patios are adjacent to the windows. Thus, there is a need for an attractive bracketing system.

The usual practice in selecting a window covering having a headrail is to measure the opening of the window and select a standard size headrail having a length that will fit the measured opening, cut down a standard size headrail to fit the window, or custom make a headrail to measure. Sometimes the measurements are made by the homeowner and sometimes an installer measures the window. Many homeowners fear that the measurements they make will be incorrect. When that does occur, the blind which has been custom made according to the measurements given by the homeowner must be replaced or cut down to the proper size. This results in additional expense to the seller as well as delay in installation. Installers also sometimes make incorrect measurements and the same problems result. There is a need for a system that will assure correct measurements are made, thereby eliminating the situation where products are sized incorrectly and an installer or homeowner attempts to install a window covering that does not fit the window opening.

SUMMARY OF THE INVENTION

I provide a bracket rail for supporting a headrail of a window covering which has an elongated L-shaped body sufficiently long to extend across substantially a full width of a window. The body is preferably L-shaped and configured to support a U-shaped headrail. I prefer to provide a plurality of brackets that releasably attached the headrail to the L-shaped body. The brackets are configured to be attached to a top portion of the headrail of the window covering. I prefer to provide a spring tab on the bracket which biases the bracket into an engaged position. In one embodiment a shoulder is provided on the back portion of the L-shaped body to receive the bottom edge of the spring.

The L-shaped body may have a plurality of spaced apart markings allowing the installer to place the bracket rail adjacent to a window opening having a smaller width than the length of the bracket rail and select the mark that corresponds to the width of the window opening. Then the bracket rail can be cut along the selected marking to produce a bracket rail that fits the window opening. In one embodiment the spaced apart markings are frangible lines on the top and the back of the L-shaped body. Then the excess length can be broken off to produce a bracket rail that fits the window opening.

A temporary shade that fits the bracket rail can be provided. This shade is typically pleated paper that can be readily cut to the proper width. Excess material can be cut away or clamped together to obtain the desired length. Cording is usually not used on temporary shades because of the lack of support for turning the cords down to the operator. The endcap and brackets in the present invention provide firm support for turning the cords.

Other objects and advantages of the invention will become apparent from a description of certain present preferred embodiments thereof shown in the drawings.

DETAILED DESCRIPTION OF THE PREFERRED EMBODIMENTS

Figure 1:
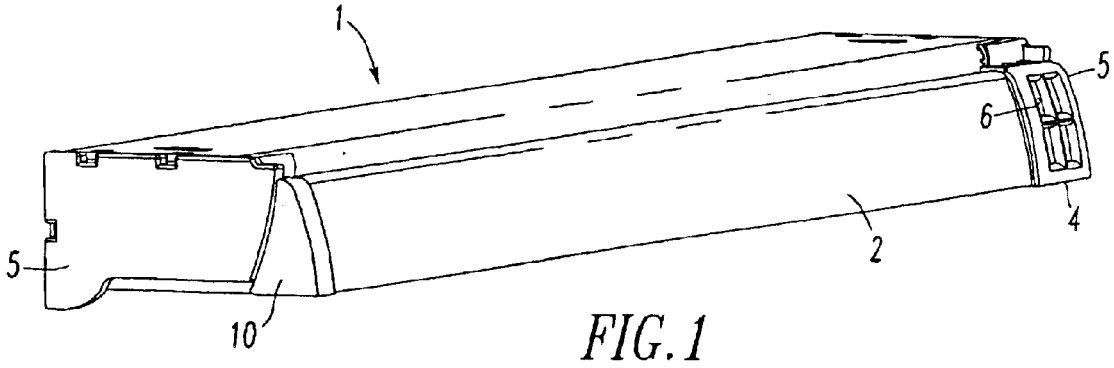
FIG. 1 is a perspective view of a present preferred embodiment of my bracket rail to which a headrail has been attached.
Figure 2:
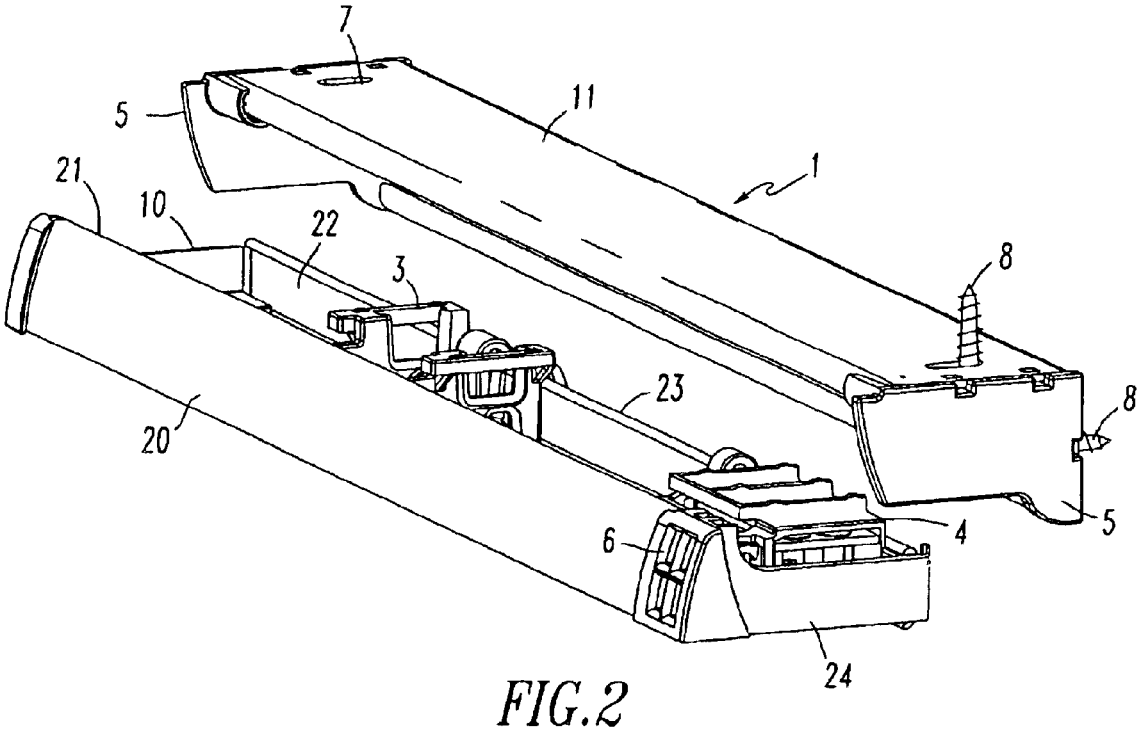
FIG. 2 is an exploded view showing the headrail and bracket rail of FIG. 1 separated as they would be prior to installation of the headrail into the bracket rail.
Figure 3:
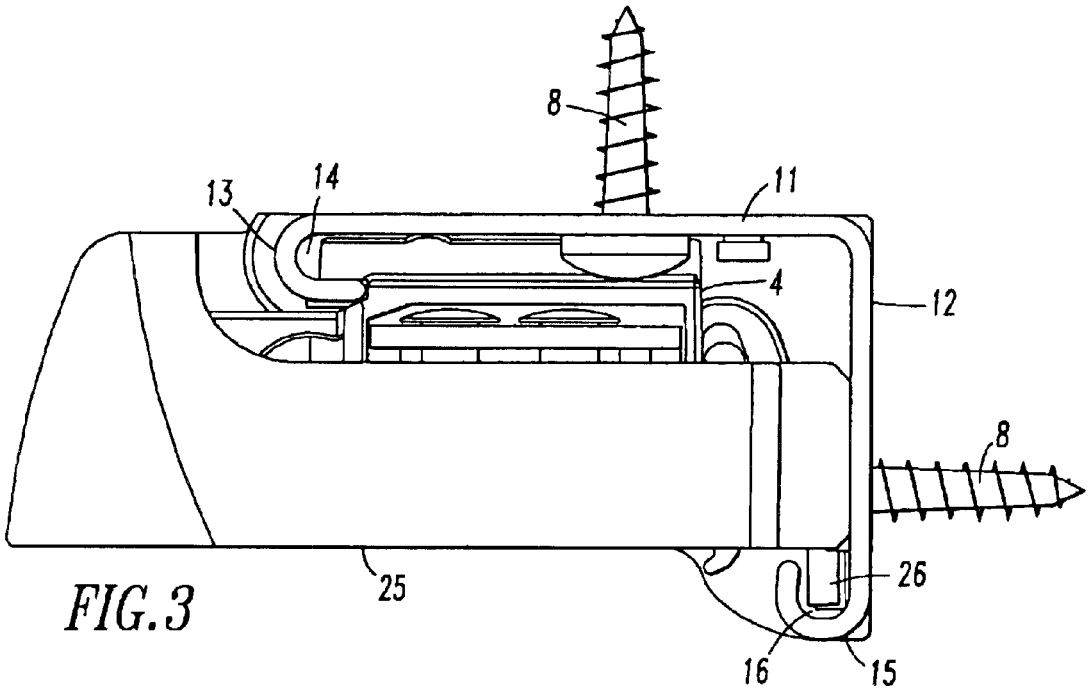
FIG. 3 is an end view of the embodiment of FIG. 1 with the end cap removed.
Figure 4:
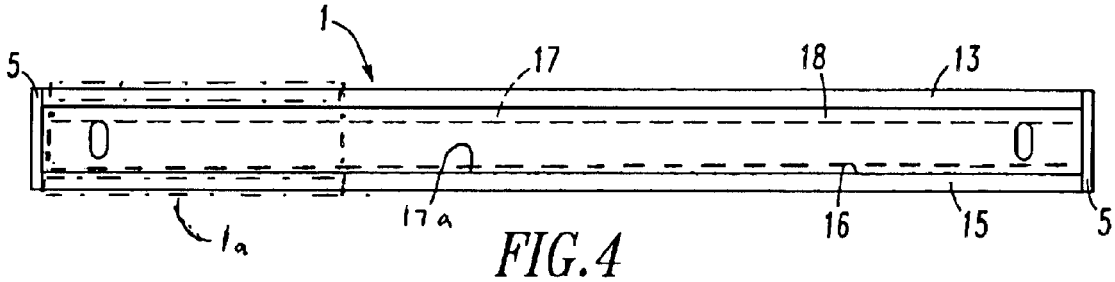
FIG. 4 is a front view of the bracket rail.

I provide a bracket rail 1 configured to hold a U-shaped headrail. The bracket rail and headrail are shown in assembled condition in FIG. 1. As can be seen in that figure, the headrail has an L-shaped elongated body is contained by two end caps 5 on either end of the body. The body of the bracket rail could be formed by two or more telescoping sections. An optional telescoping section 1*a* is shown in chain line in FIG. 4. The end caps 5 strengthen the bracket rail and laterally capture the headrail. The headrail has a front wall 20, a rear wall 22 and a bottom 25. The top edges 21 and 23 of the front wall 20 and the rear wall 22 are rolled to form a rim or shoulder along the top edge of the front wall and the top edge of the back wall 12 of the headrail.

Figure 7:
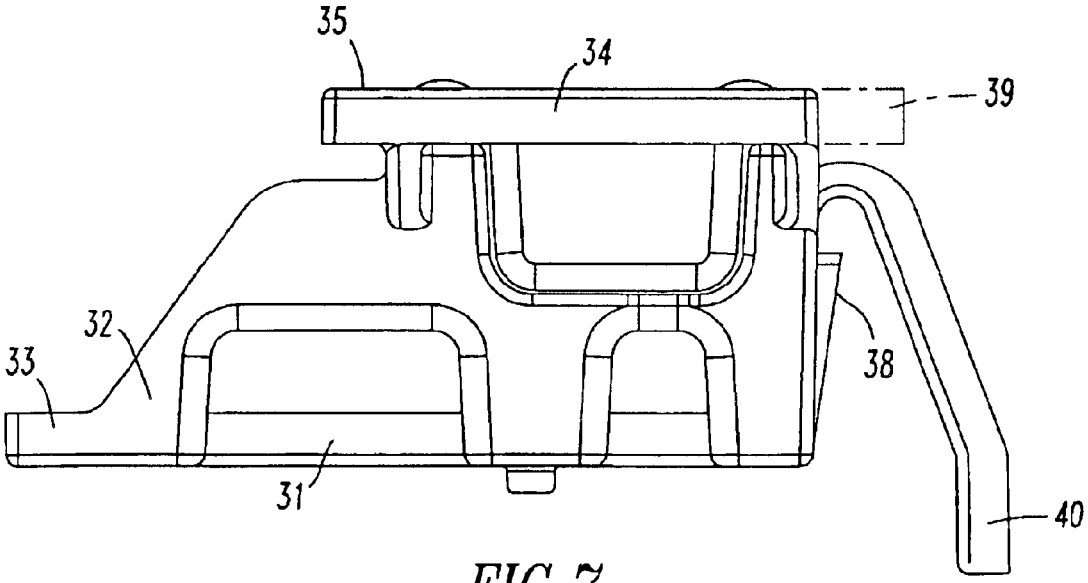
FIG. 7 is an end view of the bracket shown in FIG. 6.

The U-shaped headrail 2 is held onto the bracket rail by brackets or clips 3 that fit inside the headrail. There is also a cord release 4 configured to attach the headrail to the bracket rail. As can be seen most clearly in FIGS. 2, 3, 6 and 7, the bracket 3 has a base 31 with two upstanding sides 32. There is a rail 34 at the top of each side. The front end 35 of the rail is sized to fit within a slot 14 formed by the rolled front edge 13 of the bracket rail. A spring 37 extends from the back 36 of the bracket 3. At least one end of the headrail 2 is initially open and receives the cord lock assembly 4. An end plug 10 can be placed in the opposite end. Each bracket can be positioned in the headrail by snapping the bracket into the headrail through the top. The cord lock assembly 4 is configured to extend over the hole where one lift cord could enter the headrail. One bracket is located where each of the other lift cords enters the headrail. When the bracket is on the headrail, the tongue 33 at the front side will be under the front formed edge 21 of the headrail. A small tab 38, seen most clearly in FIG. 7, extends from the back 36 of the bracket 3 and fits underneath the rolled edge 23 of the back wall 22 of the U-shaped headrail.

Figure 8:
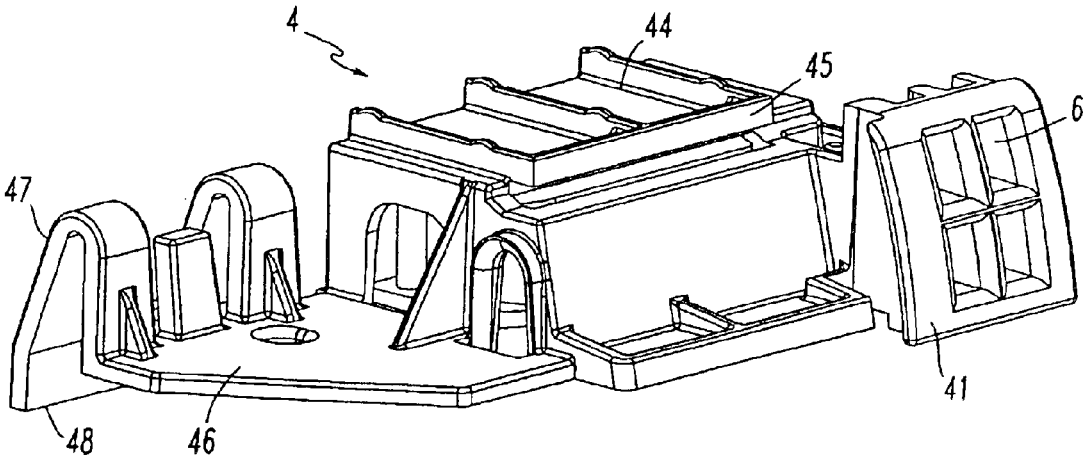
FIG. 8 is a front perspective view of a present preferred cord release assembly used in the embodiment of FIG. 1.
Figure 9:
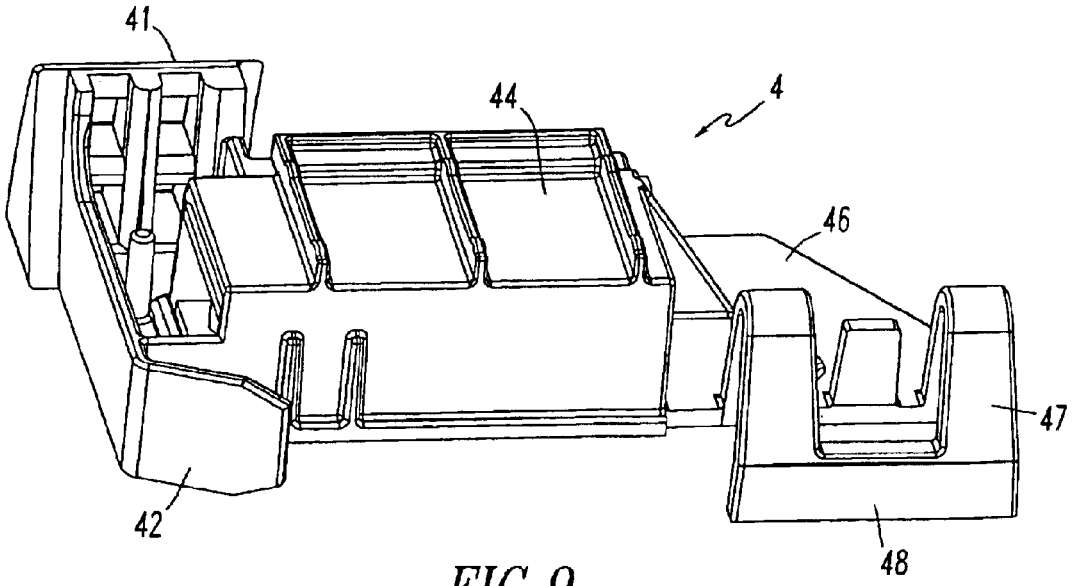
FIG. 9 is a rear perspective view of the cord release assembly shown in FIG. 8.

I prefer to provide a cord lock assembly 4 that slips onto one end of the headrail. The front 41 of the cord lock assembly 4 has slots 6 which act as a cord guide for cords exiting the cord lock. As can be seen most clearly in FIGS. 8 and 9 the cord lock assembly 4 has a main body 44 with a front tab 45 like the front 35 of the rails 34 in the bracket 3. The front tab 45 of the cord lock assembly fits within slot 14 formed by rolled edge 13 of the bracket rail. A spring 47 is provided on the base 46 of the cord lock similar to the spring 37 in the brackets. Both the brackets 3 and the cord lock assembly 4 are preferably molded plastic parts. As can be seen in the drawings, apertures are provided in the back and sides of both the brackets 3 and cord lock 4 to save material. I also provide a spring tab 42 on the outer end 24 of the cord lock. When the headrail is placed into the bracket rail, spring tab 42 as well as spring 47 on the cord lock and spring 37 on each bracket will urge the headrail forward. As can be seen most clearly in FIG. 3, spring 47 of the cord lock as well as the spring 37 of the bracket extend beyond the bottom 25 of the headrail. The bottom edge 40 of the bracket spring 37 and the bottom edge 48 of the cord release assembly spring 47 fit into slot 16 formed by rolled edge 15 on the bottom edge of the bracket rail.

To install the headrail 2 onto the bracket rail 1 the installer places the headrail at a slight downward angle into the bracket rail so that the bottom edges 40 and 48 of the spring 37 and 47 are within slot 16. Then the installer lifts the front edge of the headrail while pushing back. When the top edge 21 of the headrail butts against the front edge 13 of the bracket rail, the installer releases pressure allowing the springs 37 and 47 to push the headrail forward. This will advance the front tabs 35 of the brackets and the front edge 45 of the cord lock into the slot 14. When this is done, the headrail will be locked onto the bracket rail. The rolled bottom edge 15 of the bracket rail could be sized and configured to extend under the bottom 25 of the headrail and act as a shoulder to support the headrail. To remove the headrail from the bracket rail one simply pushes back on the headrail and tilts the front end of the headrail down. After the brackets have cleared the top 11 of the bracket rail, the headrail can be lifted to remove springs 37 and 48 from the slot 16 formed by rolled edge 15.

The bracket 3 can be configured differently to also have a tab 39 which extends from the back of rails 34. This is shown in dotted line in FIG. 7. The tab 39 is positioned to engage an optional ledge or shoulder 17 shown in dotted line in FIG. 4. This shoulder forms a slot 18 between the ledge and the top 11 of the bracket rail. If desired, the shoulder could be positioned to support the bottom of the headrail as indicated by dotted line 17*a* in FIG. 4.

Figure 5:
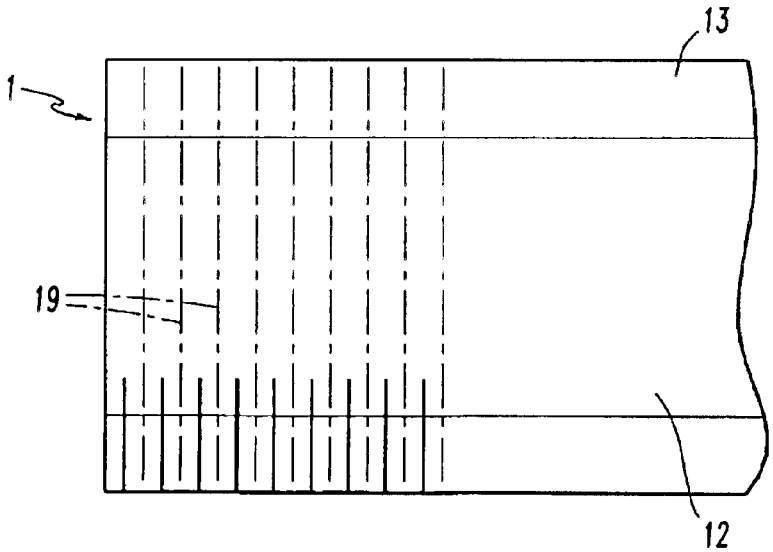
FIG. 5 is a front view of an end portion of a second preferred embodiment of the bracket rail.
Figure 6:
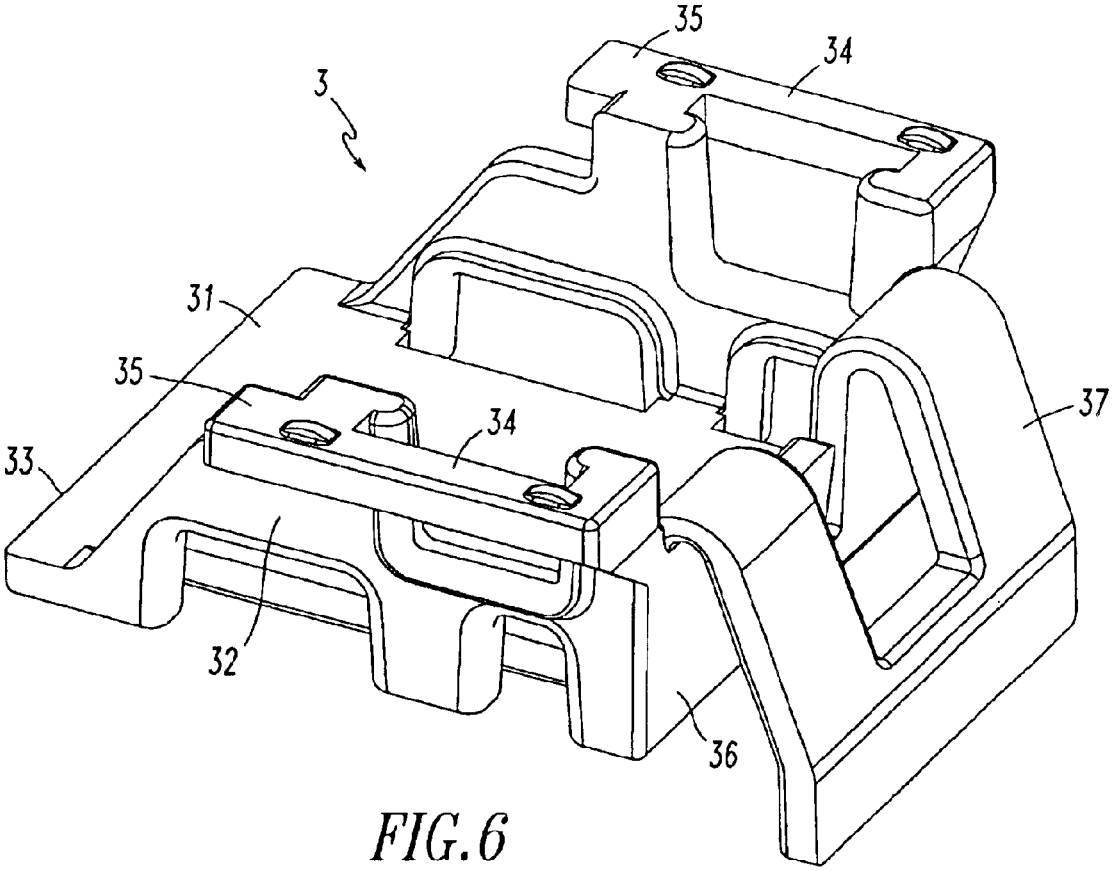
FIG. 6 is a perspective view of a present preferred bracket used in the embodiment of FIG. 1.

I prefer to provide a series of markings 19 or score lines on the bracket rail as shown in FIG. 5. These markings are preferably equally spaced by some multiple of a millimeter or a fraction of an inch. Using score lines or markings allows a single bracket rail to be used for a range of window openings. Hence, a merchant is able to stock a small number of sizes of standard bracket rails. When a customer expresses interest in buying a window covering product the merchant gives or sells the customer a bracket rail believed to be at least as long as the window opening where the window covering will be installed. The customer then takes the bracket rail to his home, places the bracket rail against the window. If the bracket rail is too long, the customer notes the marking 19 on the bracket rail which corresponds to the window opening. That measurement will also correspond to the width of the window covering that will fit the window. The customer could then either cut the bracket rail along the selected marking or score line or return it to the store to be cut down to fit his window opening. If the customer has measured the window before getting the bracket rail, the merchant could give the customer a bracket rail sized to the customer's measurement. Then, the customer could attempt to install the bracket rail to confirm the measurement. Either way, the customer uses the bracket rail to determine a measurement for the width of the window covering selected by the customer. The customer would thereby tell the store of the correct size of the window opening as determined from the bracket rail. The store could then select or cut down a headrail having a width corresponding to the window opening as determined using the bracket rail. Because end caps are installed on either end of the bracket rail the markings must be positioned to account for any thickness of the end caps. This may be done by providing pairs of markings that are numbered or lettered or of different length. For example, the shorter marking in FIG. 5 could be used for measurements while the inwardly adjacent longer score line would be the cut line. If a telescoping bracket rail is provided the marking may correspond to positions at which one telescoping section overlaps another section. The bracket rail preferably is made of metal, but could also be made of plastic. In either event, the markings could be frangible lines. The installer could then break away the excess bracket rail along the selected frangible line for easy installation of the bracket rail. One could offer one set of bracket rails with frangible lines on the right end but not on the left end. Another set of bracket rails would have frangible lines on the left end but not on the right end.

The present bracket rail system is particularly appropriate for sale by mass merchandisers, home centers, and those stores which cater to do-it-yourself customers. Some such retailers may wish to offer a full line of venetian blinds, pleated shades, cellular shades, roman shades and double shades that have headrails which are capable of being mounted on the bracket rail. A retailer who had such a product line would be able to allow customers to take home several products and try them before making a final purchase.

Figure 14:
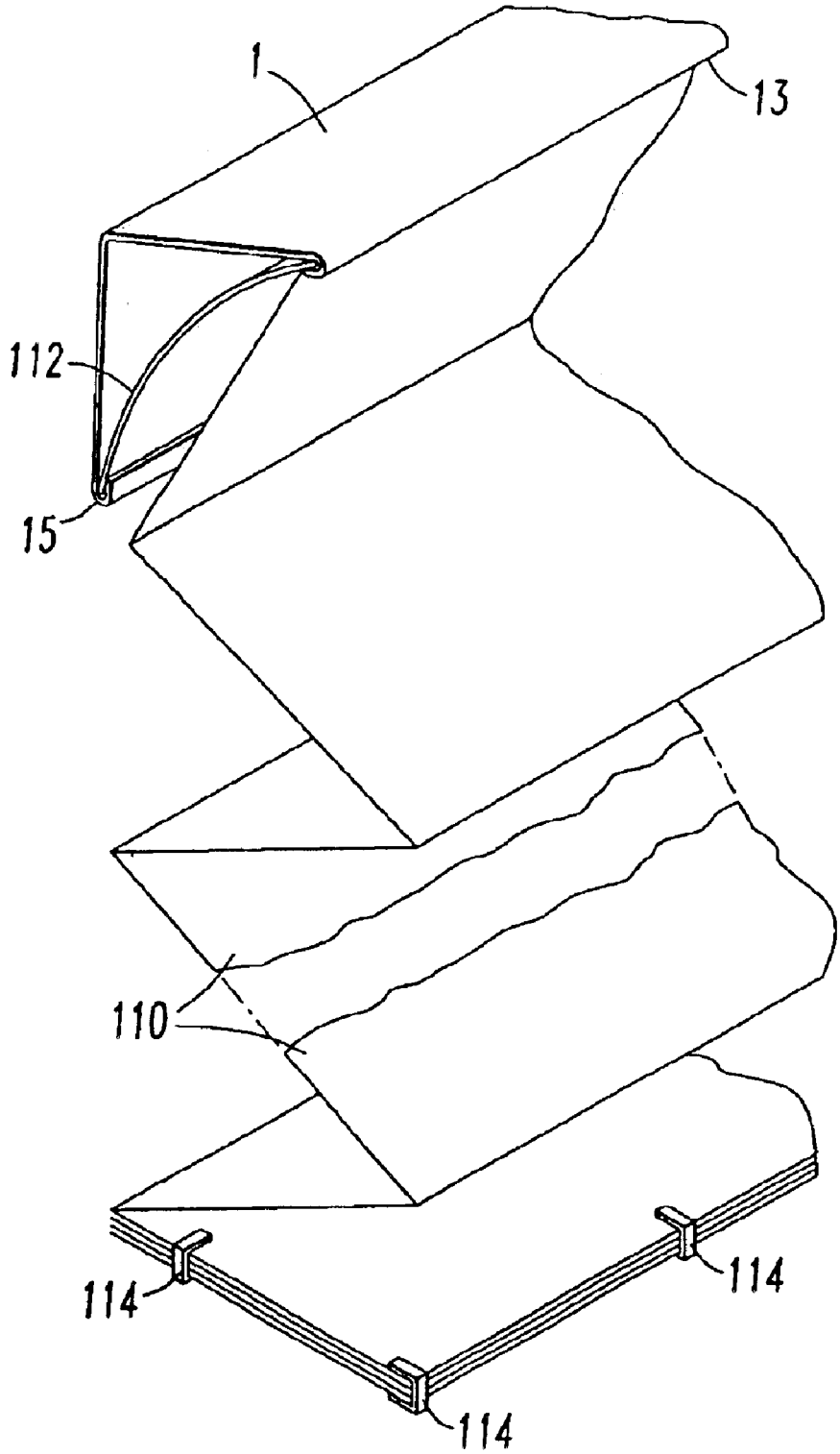
FIG. 14 is a perspective view of the bracket rail of the present invention to which a temporary shade has been attached.
Figure 15:
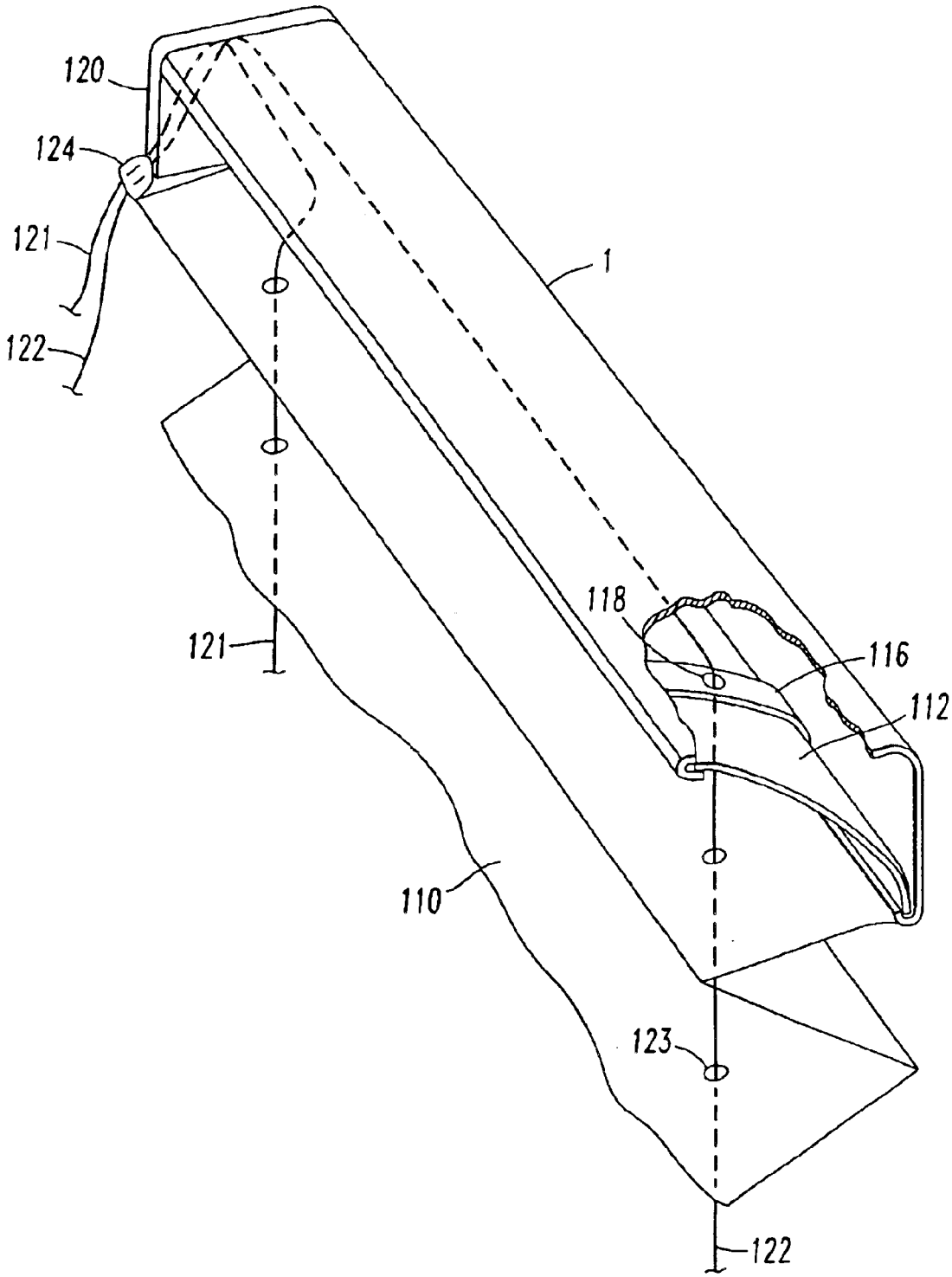
FIG. 15 is a perspective view similar to FIG. 14 showing a corded temporary shade installed on the bracket rail.

The retailer may also offer a temporary shade shown in FIG. 14. Such a shade is typically plated paper 110 attached to a plastic slat 112 that can be snapped into the bracket rail as shown. Any excess length can be cut away, but typically would simply be clipped together by clips 114 as shown. Because the bracket rail provides a ridge structure across the width of the window covering, it is possible to provide lift cords for the temporary shade as shown in FIG. 15. If lift cords 121 and 122 are to be provided, I prefer to provide a rigid bracket 116 that snaps into the bracket rail at each lift cord location. The bracket 116 could be placed on either side of the slat 112, between the slat and the bracket rail 1 or between the slat and the shade material 110. In this embodiment, slat 112 can be considered to be the headrail of the temporary shade. The lift cords are routed from the bottom of the shade, through holes 123 in the shade material, through a hole drilled in the slat and through the eyelet 118 in the bracket 116. The lift cords are then routed from the brackets through an endcap 120. A slidable stop ball 124 could be provided on the lift cords or a cleat (not shown) could be provided adjacent the window to restrain the lift cords when the shade is in a raised position.

Another advantage of the present system is that the bracket rail is prepunched with mounting holes 7 at the location where the cord lock will be located. This, of course is the location where the greatest forces act on the headrail. Consequently, the customer is forced to attach the bracket rail to the window frame at the location where forces are greatest. This is a significant advantage because home owners who have installed their own window coverings using conventional brackets have tended to equally space those brackets rather than position a bracket over the location where lift cords exit the headrail.

Use of the bracket rail exactly sized to the window in combination with end caps 5 provides several advantages. First, since the headrail 2 is exactly sized for the bracket rail, end caps 5 prevent lateral movement of the headrail after it has been mounted on the bracket rail. The bracket rail also enables positioning of the brackets at locations where the greatest forces are applied to the headrail. The specific configuration of the cord lock to have a top which engages the bracket rail securely supports the headrail where the most forces are applied. That happens when the user pulls on the cords to raise the window covering. Brackets can also be provided at locations where the lift cords pass from the headrail into the window covering material. Indeed, the brackets could also function as the cradles which carry the tilt control for a venetian blind. It should be apparent to those skilled in the art that the headrail can be used for pleated shades, cellular shades and roman shades as well as venetian blinds. The headrail can be configured to have a relatively narrow height. The bracket rail can be a single color used for all window coverings. The bracket rail and the headrail could be metal, anodized aluminum or plastic, particularly polyvinyl chloride or polycarbonate, and may be painted or covered with fabric to match any décor.

Figure 10:
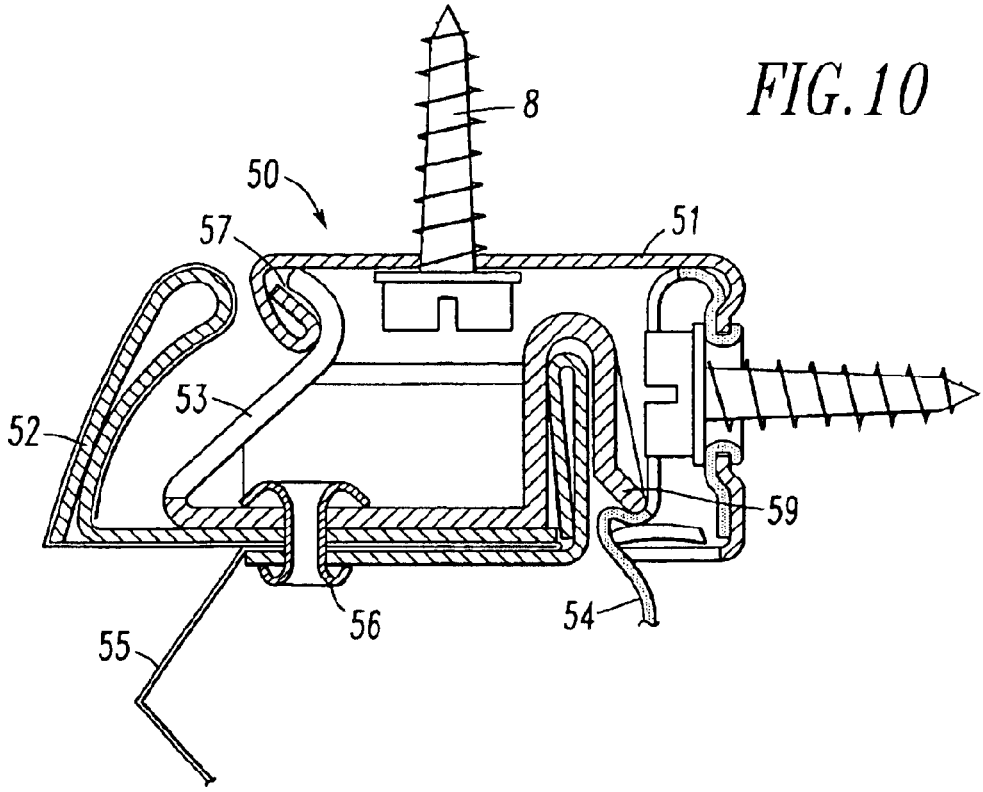
FIG. 10 is an end view similar to FIG. 3 showing a third present preferred embodiment having an alternative configuration for the brackets and bracket rail.

A third present preferred embodiment 50 shown in FIG. 10 has an elongated bracket rail 51 that receives a generally U-shaped headrail 52. Brackets 53 fits within the headrail. Each bracket is configured to have a front tab 58 that is received by the rolled front edge 57 of the bracket rail. The back of the bracket is generally U-shaped and terminates in a tab 59. The back wall of the bracket fits within in the clip 53 adjacent tab 59. A spring clip 54 is provided to receive tab 59 from the bracket. To release the headrail an operator pushes the spring clip 54 towards the back wall of the bracket rail 51. That releases tab 59 allowing the headrail to be released from the bracket rail. Pleated shade material 55 is attached to the bottom of the headrail. Eyelets 56 are provided for the lift cords.

Figure 11:
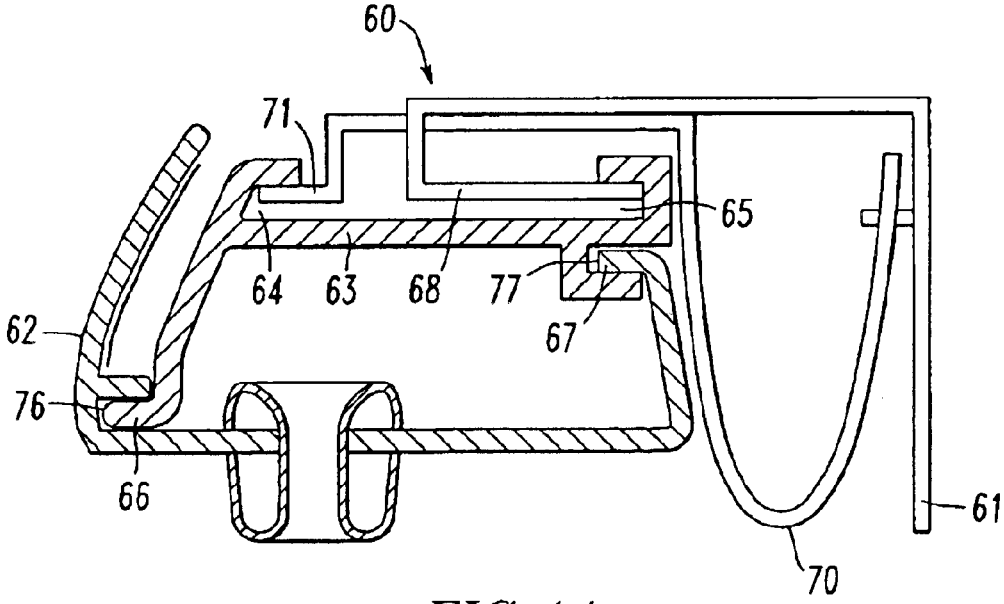
FIG. 11 is an end view similar to FIG. 10 of a fourth present preferred embodiment.

A fourth present preferred embodiment of my bracket rail system 60 is shown in FIG. 11. The bracket rail 61 is generally L-shaped with the front end being rolled back to form a tab 68. The headrail 62 is generally U-shaped, but has a slot 76 on the inside front corner of the headrail. The rear wall of the headrail has a tab 67. Tab 67 and slot 76 receive brackets 63. The tab 66 of each bracket 63 fits within slot 76. Tab 67 fits within slot 77 provided in each bracket. The upper portion of the bracket 63 is configured to have opposing slots 64 and 65. A spring clip 70 is attached at one end to the rear of the bracket rail. The opposite end of each spring clip 70 passes through a slot (not shown) cut in the bracket rail. The front end 71 of the spring clip is configured to fit within slot 64 of the bracket. To attach the headrail to the bracket rail a selected number of brackets 63 are placed within the headrail. Then the headrail is positioned so that tab 71 of spring clip 70 is within slot 64 of each bracket 63. It is anticipated that a separate spring will be used for each bracket. The headrail is pressed back enabling the rear of the headrail and bracket to be moved upward adjacent tab 68. Then, the headrail is allowed to move forward so that tab 68 is engaged in slot 65.

Figure 12:
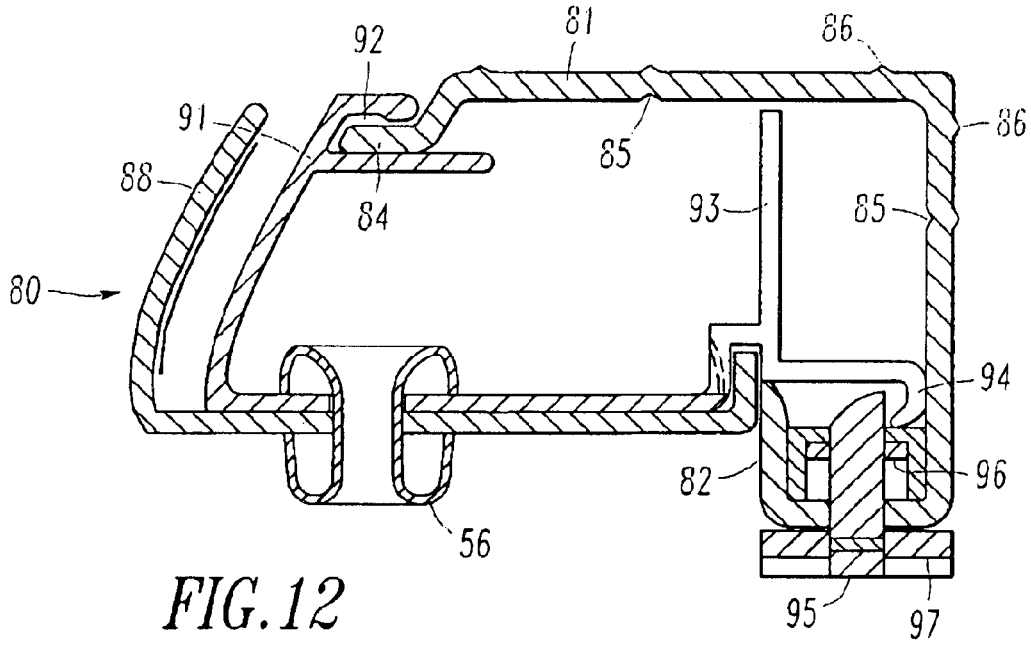
FIG. 12 is an end view similar to FIG. 10 of a fifth present preferred embodiment.

A fifth present preferred embodiment 80 is shown in FIG. 12. Bracket rail 81 is configured to have a U-shaped bottom edge which forms a slot 83. The front of the bracket rail is formed into a tab 84. A generally U-shaped headrail 88 is held onto the bracket rail by brackets 90. The front wall 91 of the bracket is configured to have a slot 92 which receives tab 84 of the bracket rail. A hook 94 extends from the rear wall 93 of the bracket and fits within slot 83. Clip 95 is shown in the locked position where it retains hook 94 within slot 83. A crown spring 96 biases clip 95 to a closed position. To release the bracket one simply pulls down on clip 95 releasing hook 94. If desired a toggle 97 can be the part of the clip which is used to move the clip form a locked position to an unlocked position. The toggle should be sized to be clearly visible when the clip is in an unlocked position. Releasing the clip 95 enables the headrail and bracket to be slid forward releasing tab 84 from slot 92. Then the headrail can be tilted and be removed from the bracket rail. In this particular bracket rail I prefer to provide drill guides 85 on the inside surface of the bracket rail. Those drill guides tell the installer where to drill holes for the screws that are used to attach the bracket rail to the window frame. I also prefer to provide foot pads 86 on the outer surface of the bracket rail. These foot pads are preferably pointed to engage the surface of the ceiling or window frame to which the bracket rail is mounted.

Figure 13:
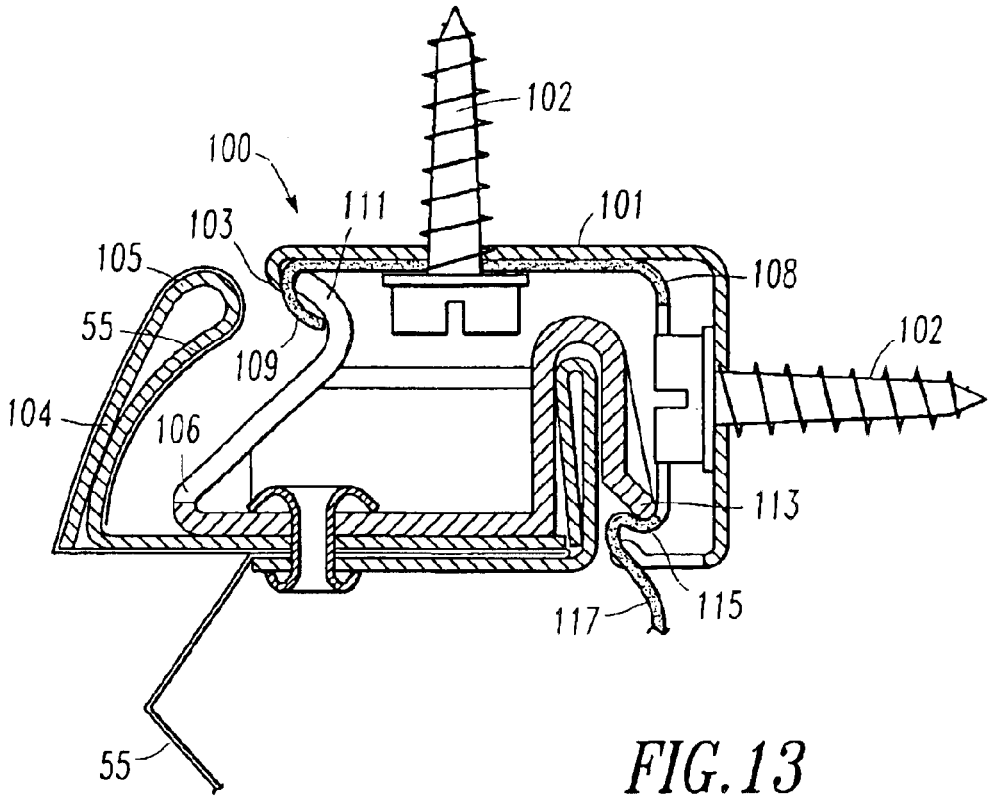
FIG. 13 is an end view similar to FIG. 11 showing a sixth present preferred embodiment.

Yet another present preferred bracket rail assembly 100 is shown in FIG. 13. The bracket rail 101 has a tab 103 along the front edge and is mounted to a window frame by wood screws 102. A generally U-shaped headrail 104 has a front wall 105 that curves back on itself. The pleated fabric material 55 covers the front wall 105 of the headrail. Bracket 106 fits in and is attached to the headrail 104. A spring clip 108 has a curved front end 109 that engages tab 103 and receives the front end 111 of the bracket 106. A tab 113 on the opposite end of the bracket 106 rests on a shoulder 115 in the spring clip. The bracket 106 can be released from the bracket rail by pushing the lower end 117 of the spring clip 108 toward the back of the bracket rail. Releasing the brackets will release the headrail 104 from the bracket rail 101.

While I have shown and illustrated certain present preferred embodiments of the invention. It should be distinctly understood that the invention is not limited thereto, but could be variously embodied within the scope of the following claims.

I claim:

1. A bracket rail for supporting a headrail of a window covering comprising:

an elongated L-shaped body having a length sufficient to extend across substantially a full width of a window, the body comprised of:

a top having a front edge, a back edge, a left end and a right end;

a back having a top edge, a bottom edge, a left end and a right end, the top edge of the back attached to the back edge of the top;

a plurality of brackets attached to the L-shaped body, the brackets configured to be attached to the headrail of the window covering;

a right end cap attached to the elongated L-shaped body adjacent the right end of the top and the right end of the back; and a left end cap attached to the elongated L-shaped body adjacent the left end of the top and the left end of the back.

2. The bracket rail of claim 1 wherein the front edge of the top is configured to form a first slot and each of the plurality of brackets having a first tab removably extending into the first slot.

3. The bracket rail of claim 2 also comprising a ledge attached to the back of the L-shaped body, the ledge being spaced apart from the top, and the each of the plurality of brackets being configured to rest on the ledge.

4. A bracket rail for supporting a headrail of a window covering comprising:

an elongated L-shaped body having a length sufficient to extend across substantially a full width of a window, the body comprised of:

a top having a front edge, a back edge, a left end and a right end, a back having a top edge, a bottom edge, a left end and a right end, the top edge of the back attached to the back edge of the top, and a ledge attached to the back of the L-shaped body, the ledge being spaced apart from the top; and a plurality of brackets attached to the L-shaped body, the brackets configured to be attached to the headrail of the window covering, each of the plurality of brackets being configured to rest on the ledge and having a resilient member positioned to press against the back of the L-shaped body and urge the first tab into the first slot.

5. The bracket rail of claim 4 wherein the resilient member has an edge that fits within a slot provided in the bracket rail.

6. The bracket rail of claim 1 also comprising longitudinally spaced apart markings on at least one of the top of the L-shaped body and the back of the L-shaped body.

7. The bracket rail of claim 6 wherein the spaced apart markings are equally spaced and spacing between adjacent markings is a fraction of an inch.

8. The bracket rail of claim 6 wherein the spaced apart markings are equally spaced and spacing between adjacent markings is a multiple of a millimeter.

9. The bracket rail of claim 6 wherein the spaced apart markings are frangible lines on the top and the back of the L-shaped body.

10. The bracket rail of claim 1 wherein at least one of the brackets and the elongated body is comprised of a material selected from the group consisting of steel, aluminum, polycarbonate and polyvinyl chloride.

11. The bracket rail of claim 1 also comprising a shoulder attached to the back, the shoulder sized and positioned to support a portion of the headrail of the window covering.

12. The bracket rail of claim 11 wherein the shoulder supports a portion of a bottom of the headrail.

13. The bracket rail of claim 1 also comprising at least one spring clip attached to the bracket rail and configured to engage at least one of the brackets.

14. The bracket rail of claim 1 also comprising a headrail attached to the brackets.

15. A bracket rail for supporting a headrail of a window covering comprising:

an elongated L-shaped body having a length sufficient to extend across substantially a full width of a window, the body comprised of;

a top having a front edge, a back edge, a left end and a right end, a back having a top edge, a bottom edge, a left end and a right end, the top edge of the back attached to the back edge of the top, and a ledge attached to the back of the L-shaped body, the ledge being spaced apart from the top;

a plurality of brackets attached to the L-shaped body, the brackets configured to be attached to the headrail of the window covering; and a cord release assembly attached to one of the plurality of brackets.

16. The bracket rail of claim 1 wherein the elongated L-shaped body is comprised of at least two telescoping sections.

17. The bracket rail of claim 1 also comprising a temporary shade attached to the bracket rail.

18. The bracket rail of claim 17 also comprising lift cords attached to the temporary shade and running through the bracket rail.

19. A method of selling window coverings of the type having a headrail comprising:

giving a customer a bracket rail suitable for mounting the headrail of the window covering being offered for sale, the bracket rail comprising an elongated body having a length at least as great as a width of a window over which the window covering to be sold is intended to be placed;

instructing the customer to place the bracket rail over that window over which the window covering to be sold is intended to be placed, and to use the bracket rail to determine a measurement that corresponds to a width of the window covering to be installed; and selecting a window covering having a headrail whose width corresponds to the measurement.

20. The method of claim 19 wherein the bracket rail is comprised of longitudinally spaced apart markings on the elongated body.

21. The method of claim 20 wherein the spaced apart markings are equally spaced and spacing between adjacent markings is a fraction of an inch.

22. The method of claim 20 wherein the spaced apart markings are equally spaced and spacing between adjacent markings is a multiple of a millimeter.

23. The method of claim 20 wherein the elongated body has a top and a back and the spaced apart markings are frangible lines on the top and the back of the elongated body.

24. The method of claim 19 also comprising shortening the bracket rail to a length corresponding to the measurement.

25. The method of claim 19 also comprising mounting the bracket rail and installing the selected window covering on the bracket rail.

26. The method of claim 19 also comprising:

mounting the bracket rail;

installing a temporary shade on the bracket rail;

removing the temporary shade; and replacing the temporary shade with the selected window covering.

27. The method of claim 19 also comprising stocking a selection of window coverings, each window covering having a headrail whose length is one of a selected number of stock lengths, and wherein the window covering is selected by choosing a window covering whose headrail has a stock length greater than a length corresponding to the marking or markings identified by the customer and cutting down the window covering to have a headrail whose length corresponds to the marking or markings identified by the customer.

* * * * *